US009309622B2

(12) United States Patent
Higuchi

(10) Patent No.: US 9,309,622 B2
(45) Date of Patent: Apr. 12, 2016

(54) SHEET MANUFACTURING APPARATUS

(71) Applicant: SEIKO EPSON CORPORATION, Tokyo (JP)

(72) Inventor: Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/624,894

(22) Filed: Feb. 18, 2015

(65) Prior Publication Data

US 2015/0240417 A1 Aug. 27, 2015

(30) Foreign Application Priority Data

Feb. 21, 2014 (JP) ..... 2014-031424

(51) Int. Cl.
*D21D 5/00* (2006.01)

(52) U.S. Cl.
CPC ..... *D21D 5/00* (2013.01)

(58) Field of Classification Search
USPC ..... 162/261
IPC ..... D21D 5/00
See application file for complete search history.

(56) References Cited

U.S. PATENT DOCUMENTS

2014/0027075 A1 1/2014 Yamagami et al.

FOREIGN PATENT DOCUMENTS

JP 05-279985 A 10/1993
JP 2012-144819 A 8/2012

*Primary Examiner* — Mark Halpern
(74) *Attorney, Agent, or Firm* — Global IP Counselors, LLP

(57) ABSTRACT

The sheet manufacturing apparatus includes a defibrating unit configured to defibrate a defibration object in the air, and a sheet forming unit configured to form a sheet by using at least a part of defibrated material that has been defibrated by the defibrating unit. The flow path configured to transfer the defibration object to the defibrating unit has a pipeline unit through which the defibration object passes, an opening having a size through which the defibration object does not pass on a surface of the pipeline unit, and an enclosure unit enclosing the pipeline unit such that the opening is positioned inside.

5 Claims, 6 Drawing Sheets

SHEET MANUFACTURING APPARATUS

CROSS-REFERENCE TO RELATED APPLICATIONS

This application claims priority to Japanese Patent Application No. 2014-031424 filed on Feb. 21, 2014. The entire disclosure of Japanese Patent Application No. 2014-031424 is hereby incorporated herein by reference.

BACKGROUND

1. Technical Field

The present invention relates to a sheet manufacturing apparatus.

2. Related Art

Conventionally, a so-called wet system is adopted in a sheet manufacturing apparatus to inject raw materials containing fibers into water, defibrate primarily by mechanical actions, and repulp. This kind of wet-type sheet manufacturing apparatus requires a large quantity of water, and the apparatus becomes large. Furthermore, in addition to the long time it takes for equipment maintenance of the water treatment facilities, the energy related to the drying process becomes substantial.

Therefore, a sheet manufacturing apparatus based on a dry system that uses as little water as possible in order to reduce the size and to save energy is proposed (e.g., see Japanese Laid-Open Patent Publication No. 2012-144819).

Japanese Laid-Open Patent Publication No. 2012-144819 describes defibration of pieces of paper into a fibrous form in a dry-type defibrating apparatus, classifies the fibers in a cyclone into ink particles and deinked fibers, passes the deinked fibers through a screen with small holes on the surface of a forming drum for depositing on a mesh belt, and forms into paper.

In a dry-type defibrating apparatus, the noise including the defibration sounds generated when defibrating pieces of paper is relatively large in a sheet manufacturing apparatus. Japanese Laid-Open Patent Publication No. H5-279985 discloses a sound muffler for absorbing the noise created by the rotation of a rotor inserted between the material receiving port and the housing in a crushing device that crushes ramie and hemp.

The problem of the sound muffler disclosed in Japanese Laid-Open Patent Publication No. H5-279985 is that the sudden expansion of the cross-sectional area of the pipe is used to muffle the sound, but when the flow path expands, the materials accumulate inside of the sound muffler. In addition, when a taper is provided on the downstream side to prevent the accumulation of material, the problems are the reduced performance of sound muffling, the difficulty in reducing the size because of the increased length in the transfer direction, and the inability to position horizontally.

SUMMARY

The present invention solves at least a portion of the problems described above and can be implemented in the following embodiments or applied examples.

An embodiment of a sheet manufacturing apparatus related to the invention is provided with a defibrating unit configured to defibrate a defibration object in the air, a sheet forming unit configured to form a sheet by using at least a part of defibrated material that has been defibrated by the defibrating unit, and a flow path configured to transfer the defibration object to the defibrating unit. The flow path has a pipeline unit through which the defibration object path, an opening having a size through which the defibration object does not pass on a surface of the pipeline unit, and an enclosure unit enclosing the pipeline unit such that the opening is positioned inside.

In this kind of sheet manufacturing apparatus, by providing an opening on the surface of the pipeline unit through which the defibration object passes and providing an enclosure unit that encloses the pipeline unit so that the opening is positioned on the inside in the flow path for transferring the defibration object to the defibrating unit, the noise of the defibrating unit can be reduced. In addition, by making the size of the opening a size through which the defibration object does not pass, the accumulation of the defibration object in the space between the surface of the pipeline unit and the enclosure unit can be prevented.

In the sheet manufacturing apparatus related to the invention, the opening may be an opening formed in a mesh unit having a net-like form. Namely, the size of the opening may be the apertures in a net-like mesh unit (intervals between holes in the mesh unit).

In this kind of sheet manufacturing apparatus, the opening provided in the pipeline unit can be an opening formed from a net-like mesh unit, and can increase the total area of the opening to improve the sound muffling performance.

In the sheet manufacturing apparatus related to the invention, the mesh unit may be arranged in an entire circumference in a circumferential direction of the pipeline unit.

In this kind of sheet manufacturing apparatus, a mesh unit can be provided to cover the entire circumference in the circumferential direction of the pipeline unit, and the total area of the opening can be increased to improve the sound muffling performance. In addition, the sounds in a wide frequency band can be reduced.

In the sheet manufacturing apparatus related to the invention, the mesh unit may be arranged in a part in the circumferential direction of the pipeline unit.

In this kind of sheet manufacturing apparatus, the sounds in a specified frequency band can be reduced.

The sheet manufacturing apparatus related to the invention may also have a crushing unit configured to crush materials containing fibers, and the defibrating unit is configured to defibrate in the air a crushed piece that has been crushed by the crushing unit as the defibration object, and the flow path may be provided between the crushing unit and the defibrating unit.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the present invention are explained in detail below with reference to the drawings. The embodiments explained below do not unfairly limit the content of the present invention described in the Scope of the Patent Claims. In addition, the overall configuration described below does not limit the indispensable structural requirements of the present invention.

1. Overall Configuration

Figure 1:
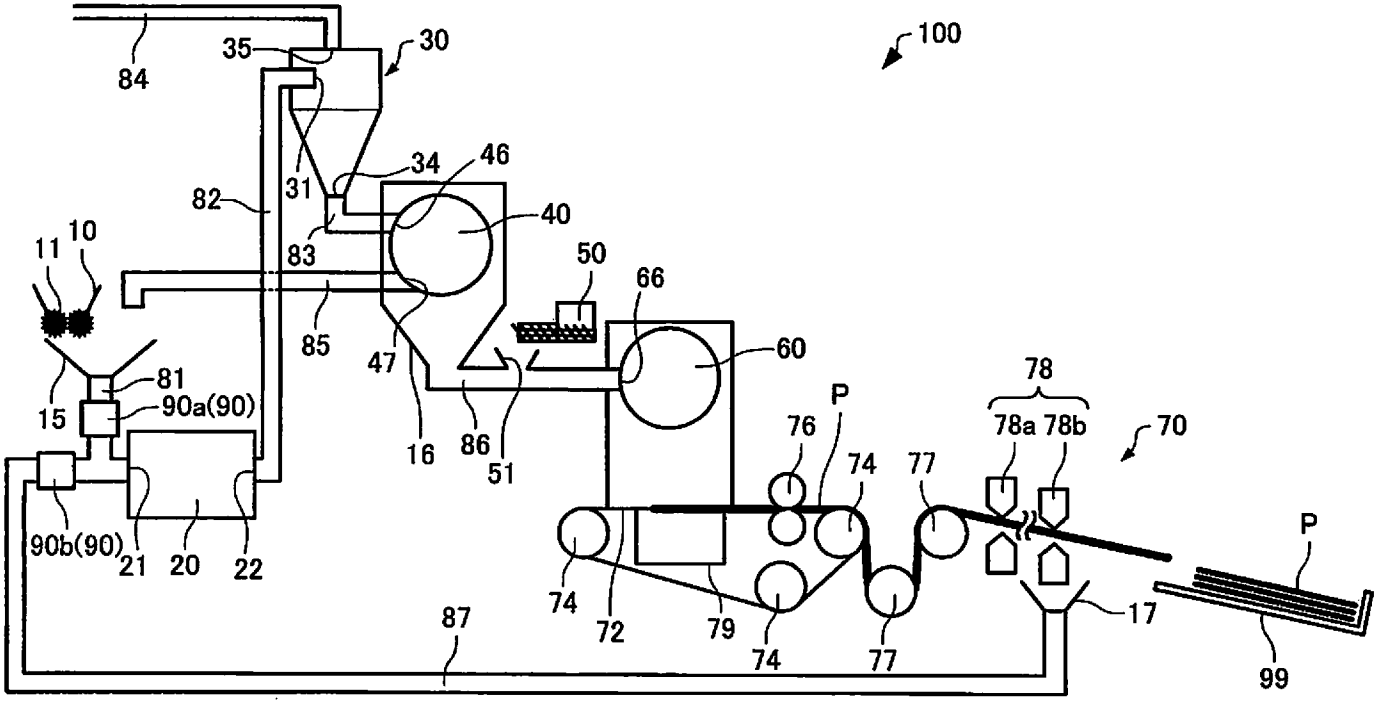
FIG. 1 schematically shows a sheet manufacturing apparatus related to this embodiment.

FIG. 1 is a drawing that schematically shows a sheet manufacturing apparatus 100 related to this embodiment. As shown in FIG. 1, the sheet manufacturing apparatus 100 includes a crushing unit 10, a defibrating unit 20, a classifying unit 30, a screening unit 40, a resin supply unit 50, a refining unit 60, and a sheet forming unit 70.

The crushing unit 10 cuts (crushes) the raw materials such as pulp sheets or fed-in sheets (e.g., used A4-size paper) into small pieces (crushed pieces) in the air. The shapes and sizes of the pieces are not particularly limited, but, for example, the pieces are several centimeters (cm) or several millimeters (mm) square. In the example shown, the crushing unit 10 has a crushing blade 11 and can cut the fed-in raw materials by using this crushing blade 11. An automatic feeding unit (not shown) may be provided in the crushing unit 10 to continuously feed in raw materials.

After being received in a hopper 15, the pieces cut by the crushing unit 10 are transferred by a first transfer unit 81 to the defibrating unit 20. The first transfer unit 81 combines flows with a seventh transfer unit 87 to be described later and connects to an introduction port 21 of the defibrating unit 20. For example, the shapes of the first transfer unit 81 and the second to the seventh transfer units 82 to 87, which are described later, are tubular. A sound muffling unit 90 for reducing the noise generated by the defibrating unit 20 is provided in each of the first transfer unit 81 and the seventh transfer unit 87 (one example of the flow path for transferring the defibration object). The first sound muffling unit 90*a* is provided in the first transfer unit 81, and the second sound muffling unit 90*b* is provided in the seventh transfer unit 87.

The defibrating unit 20 defibrates the small pieces (defibration object). The defibrating unit 20 creates fibers refined into a fibrous form by defibrating the small pieces.

Here, "defibrates" refers to untangling the pieces of a plurality of bonded fibers into individual fibers. The objects that passed the defibrating unit 20 are referred to as "defibrated material." In addition to the untangled fibers, particles of resin (resin for bonding a plurality of fibers together) and ink particles, such as ink, toner, and blur-preventing materials, that were separated from the fibers when the fibers were untangled may also be included in the "defibrated material." In the later description, "defibrated material" may be at least a portion of the material that passed through the defibrating unit 20, or may be mixed material mixed with additives that were added after passing through the defibrating unit 20. In addition, "defibrated material" refers to the material defibrated by the defibrating unit 20.

The defibrating unit 20 separates the resin particles or ink particles, such as ink, toner, or blur-preventing materials, attached to the pieces from the fibers. The resin particles and ink particles are discharged from a discharge port 22 with the defibrated material. The defibrating unit 20 defibrates the pieces introduced from an introduction port 21 by a rotating blade. The defibrating unit 20 defibrates in the air in a dry system.

Preferably, the defibrating unit 20 has a mechanism for generating airflow. In this case, the defibrating unit 20 can suction the pieces with the airflow from the introduction port 21 using the self-generated airflow, defibrate, and transfer to the discharge port 22. As shown in FIG. 1, the defibrated material discharged from the discharge port 22 is introduced to the classifying unit 30 via the second transfer unit 82. If the defibrating unit 20 being used does not have an airflow generation mechanism, a mechanism that generates airflow to introduce pieces into the introduction port 21 may be attached externally.

The classifying unit 30 separates and removes resin particles and ink particles from the defibrated material. An airflow classifier is used as the classifying unit 30. An airflow classifier generates a rotating airflow to separate by size and density the materials being classified by using centrifugal force, and the classification points can be adjusted by adjusting the speed of the airflow, and the centrifugal force. Specifically, a cyclone, an elbow jet, and an eddy classifier, and the like are used as the classifying unit 30. In particular, the cyclone can be preferably used as the classifying unit 30 because of its simple configuration. Cases in which a cyclone is used as the classifying unit 30 are explained below.

The classifying unit 30 has at least an introduction port 31, a lower discharge port 34 provided in the lower part, and an upper discharge port 35 provided in the upper part. In the classifying unit 30, the airflow carrying defibrated material that was introduced from the introduction port 31 has circular motion. By doing this, centrifugal forces are applied to the introduced defibrated material to separate the material into fiber materials (untangled fibers) and waste materials that are smaller and less dense than the fiber materials (resin particles, ink particles). The fiber materials are discharged from the lower discharge port 34 and introduced into an introduction port 46 of the screening unit 40 through the third transfer unit 83. On the other hand, the waste materials are discharged to the outside of the classifying unit 30 from the upper discharge port 35 through the fourth transfer unit 84. Thus, because the resin particles are discharged to the outside by the classifying unit 30, excess resin for the defibrated material can be prevented even when resin is supplied by a resin supply unit 50 to be described later.

The classification into fiber materials and waste materials by the classifying unit 30 was described, but exact separation is not possible. Among the fiber materials, relatively small fiber materials and low-density fiber materials are sometimes discharged to the outside with the waste materials. In addition, among the waste materials, relatively high-density waste materials or waste materials entangled with fiber materials are sometimes introduced with the fiber materials to the screening unit 40. In this application, the materials discharged from the lower discharge port 34 (materials having a higher percentage of including long fibers than waste materials) are referred to as "fiber materials." Materials discharged from the upper discharge port 35 (materials having a lower percentage of including long fibers than fiber materials) are referred to as "waste materials." When the raw material is not used paper but a material like pulp sheet, the classifying unit 30 may be omitted from the configuration of the sheet manufacturing apparatus 100 because materials corresponding to waste materials are not included.

The screening unit 40 screens the fiber materials separated by the classifying unit 30 in the air into "passed material" that passes through the screening unit 40 and "residue" that does not pass through. A sieve is used as the screening unit 40. The screening unit 40 has an introduction port 46 and a discharge port 47. The screening unit 40 is a rotating sieve that rotates a mesh unit by using a motor (not shown). The mesh unit of the screening unit 40 has a plurality of openings. Among the fiber materials in the mesh unit, materials having sizes that are able to pass through the openings are passed, and materials having sizes that are unable to pass through the openings are not passed when the mesh unit is rotated. The screening unit 40 can use the sieve to screen the fibers shorter than a constant length (passed material) from the fiber materials. The mesh unit is configured from a metal mesh such as a woven metal mesh or a welded metal mesh. The mesh unit is a metal mesh formed into a cylinder, and the interior of the cylinder is a cavity. In the screening unit 40, the mesh unit configured from a metal mesh may be replaced by an expanded metal that is an extended metal plate with slits, or may be a punched metal of a metal plate formed with holes by a metal pressing machine. When the expanded metal is used, the openings are the holes formed by lengthening the slits made in the metal plate. When the punched metal is used, the openings are the holes formed in a metal plate by a pressing machine. In addition, parts having openings may be produced from materials other than metal. The screening unit 40 may be omitted from the configuration of the sheet manufacturing apparatus 100.

Residue that was not passed by the sieve of the screening unit 40 is discharged from the discharge port 47, transferred to the hopper 15 through a fifth transfer unit 85 as the return flow path, and returned again to the defibrating unit 20. On the other hand, the passed material that passed through the sieve of the screening unit 40 is transferred through the sixth transfer unit 86 after being received in the hopper 16 to an introduction port 66 of the refining unit 60. A supply port 51 is provided in the sixth transfer unit 86 to supply resin for bonding fibers together (bonding defibrated materials together).

A resin supply unit 50 supplies resin in the air from the supply port 51 to the sixth transfer unit 86. That is, the resin supply unit 50 supplies resin in the path (between the screening unit 40 and the refining unit 60) of the passed material that passed through the openings of the screening unit 40 from the screening unit 40 to the refining unit 60. The resin supply unit 50 is not particularly limited if resin can be supplied to the sixth transfer unit 86; and a screw feeder, a circle feeder, and the like are used. Resin supplied from the resin supply unit 50 is resin for bonding a plurality of fibers. When resin is supplied to the sixth transfer unit 86, the plurality of fibers is not bonded. The resin hardens when passed through the forming unit 70 to be described later to bond the plurality of fibers. The resin is thermoplastic resin or thermosetting resin, and may be in a fibrous or a powder form. The amount of resin supplied from the resin supply unit 50 is appropriately set corresponding to the type of sheet to be manufactured. In addition to resin for bonding the fibers, coloring agents for coloring the fibers and coagulation inhibitors for preventing the coagulation of fibers may also be supplied corresponding to the type of sheet to be manufactured. The resin supply unit 50 may be omitted from the configuration of the sheet manufacturing apparatus 100.

The resin supplied from the resin supply unit 50 is mixed with the passed material that passed through the openings of the screening unit 40 by a mixing unit (not shown) provided in the sixth transfer unit 86. The mixing unit generates airflow to transfer to the refining unit 60 while mixing together the passed material and the resin.

The refining unit 60 refines the entangled passed material. Furthermore, the refining unit 60 refines the entangled resin when the resin supplied from the resin supply unit 50 is fibrous. In addition, the refining unit 60 uniformly deposits the passed material and the resin in the deposition unit 72 to be described later. The term "refine" includes the action that separates entangled objects and the action that uniformly deposits. If there are no entangled materials, the action of uniform deposition results. A sieve is used as the refining unit 60. The refining unit is a rotary sieve that rotates a mesh unit by a motor (not shown). Here, the "sieve" that is used as the refining unit 60 may not have the function of screening specific target objects. That is, the "sieve" used as the refining unit 60 means an object provided with a mesh unit having a plurality of openings. The refining unit 60 may discharge all of the fiber materials and resin introduced to the refining unit 60 to the outside from the openings. In this case, the size of the openings of the refining unit 60 is at least the size of the openings of the screening unit 40. The configuration difference between the refining unit 60 and the screening unit 40 is that the refining unit 60 has a discharge port (part corresponding to discharge port 47 of the screening unit 40). The refining unit 60 may be omitted from the configuration of the sheet manufacturing apparatus 100.

In the state in which the refining unit 60 is rotating, a mixture of the passed material (fibers) that passed through the screening unit 40 and the resin is introduced from the introduction port 66 into the refining unit 60. The mixture introduced into the refining unit 60 moves to the mesh unit side by centrifugal force. As described above, the mixture introduced to the refining unit 60 sometimes includes entangled fibers and resin. The entangled fibers and resin are refined in the air by the rotating mesh unit. Then the refined fibers and resin pass through the openings. The fibers and resin that passed through the openings pass through the air and are uniformly deposited in the deposition unit 72 to be described later.

The fiber materials and resin that passed through the openings of the refining unit 60 are deposited in the deposition unit 72 of the forming unit 70. The sheet forming unit 70 has a deposition unit 72, a stretching roller 74, a heater roller 76, a tension roller 77, and a cutting unit 78. The sheet forming unit 70 uses the defibrated material and resin that passed through the refining unit 60 to form a sheet.

The deposition unit 72 of the sheet forming unit 70 receives and deposits the fiber materials and resin that passed through the openings of the refining unit 60 to form the deposited material. The deposition unit 72 is positioned below the refining unit 60. The deposition unit 72 is, for example, a mesh belt. A mesh that is stretched by the stretching roller 74 is formed on the mesh belt. The deposition unit 72 is moved by the rotation of the stretching roller 74. While the deposition unit 72 continuously moves, the defibrated material and resin from the refining unit 60 continuously drop down and deposit to form a web having uniform thickness on the deposition unit 72.

A suction apparatus 79 (suction unit) for suctioning the deposited material from below is provided below the deposition unit 72. The suction apparatus 79 is positioned below the refining unit 60 with the deposition unit 72 therebetween to generate airflow directed downward (flow directed from the refining unit 60 to the deposition unit 72). Thus, the defibrated material and resin dispersed in the air can be suctioned, and the discharge speed from the refining unit 60 can be increased. The result is that the productivity of the sheet manufacturing apparatus 100 can be improved. In addition, a downflow can be formed in the drop path of the defibrated material and the resin by the suction apparatus 79, and the defibrated material and the resin can be prevented from becoming entangled during the drop.

The defibrated material and resin deposited on the deposition unit 72 of the forming unit 70 are heated and pressurized by passing through the heater rollers 76 accompanying the motion of the deposition unit 72. By heating, the resin functions as a bonding agent to bond fibers together, and by applying pressure, the material is thinned. Furthermore, the surface is smoothed by passing through calendar rollers, which are not shown, to form a sheet P.

A first cutting unit 78*a* for cutting the sheet P in a direction that intersects the transfer direction of the sheet P and a second cutting unit 78*b* for cutting the sheet P along the transfer direction of the sheet P are arranged as a cutting unit 78 that cuts the sheet P further downstream than the heater roller 76. The first cutting unit 78*a* is provided with a cutter and cuts the continuous sheet P into sheets at cutting positions set to a specified length. The second cutting unit 78*b* is provided with a cutter and cuts the sheet P at the specified cutting position in the transfer direction of the sheet P. By doing this, sheets having the desired size are formed. The cut sheets P are loaded in a stacker 99. In addition, pieces crushed (cut) by the second cutting unit 78*b* are received by a hopper 17, and then transferred through the seventh transfer unit 87 to the introduction port 21 of the defibrating unit 20. The configuration may wind up the continuous sheet P without being cut onto a wind-up roller. From the above, the sheet P can be constructed.

2. Configuration of Sound Muffling Unit

Noise generated in the defibrating unit 20 (sounds of collisions and fluid sounds of the defibration object) leave through the hopper 15 via the first transfer unit 81 and through the hopper 17 at the open end via the seventh transfer unit 87. Therefore, in the sheet manufacturing apparatus 100 of this embodiment, in order to reduce the noise of the defibrating unit 20, a sound muffling unit 90 is provided in each of the first transfer unit 81 and the seventh transfer unit 87.

Figure 2A:
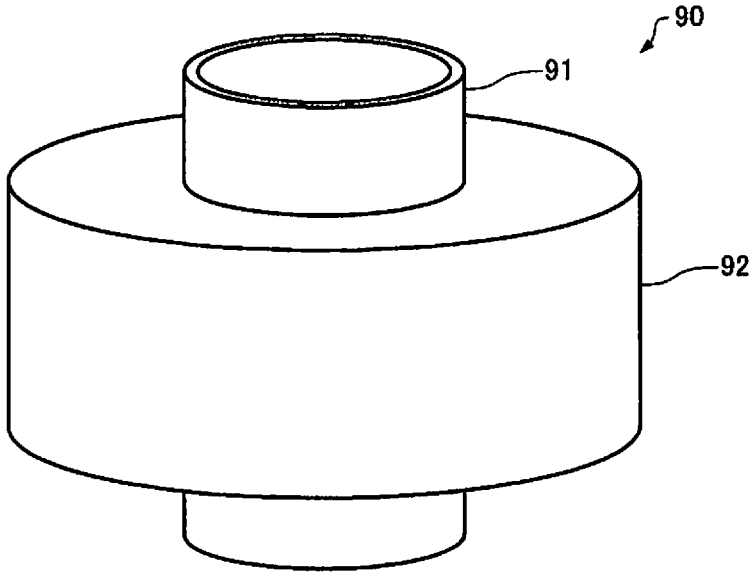
FIG. 2A is a perspective diagram that schematically shows a sound muffling unit.
Figure 2B:
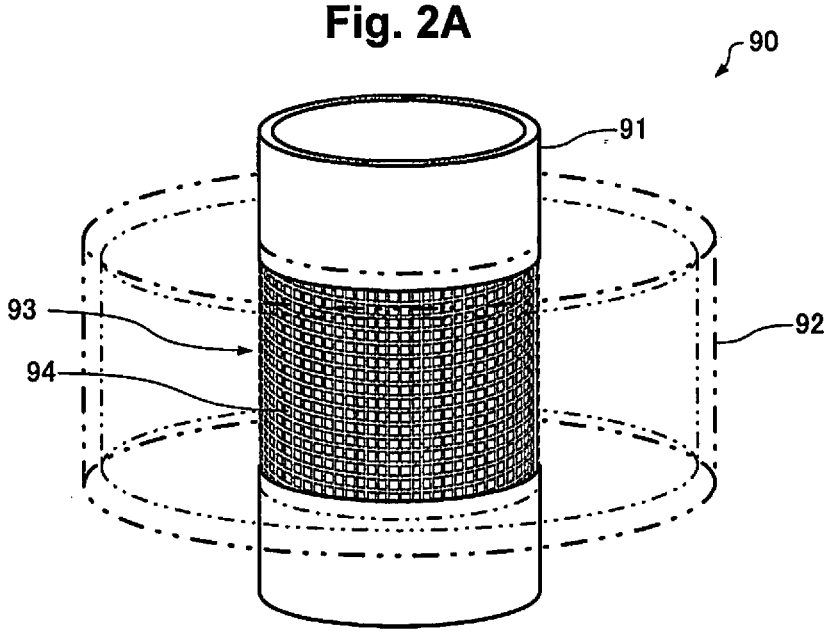
FIG. 2B is a perspective diagram the schematically shows the interior of the sound muffling unit.

FIG. 2A is a perspective diagram that schematically shows the sound muffling unit 90 (90*a*, 90*b*). FIG. 2B is a perspective diagram that schematically shows the interior of the sound muffling unit 90. As shown in FIG. 2A, the sound muffling unit 90 has a pipeline unit 91 that passes the defibration object and an enclosure unit 92 that encloses a portion of the pipeline unit 91. The pipeline unit 91 constructs a part of the first transfer unit 81 or the seventh transfer unit 87. The cross-sectional shape of the pipeline unit 91 is circular. The sound muffling unit 90 functions as the flow path for transferring the defibration object to the defibrating unit 20.

In FIG. 2B, the exterior and interior shapes of the enclosure unit 92 are indicated by the two-dot-dash lines. As shown in FIG. 2B, a mesh unit 93 having a plurality of openings 94 is formed in a part of the pipeline unit 91. In the example shown in FIG. 2B, the mesh unit 93 is formed into a cylindrical shape that passes over the entire circumference in the circumferential direction of the pipeline unit 91. For example, the mesh unit 93 is constructed from a metal mesh such as a woven metal mesh or a welded metal mesh, and the metal mesh is formed into a cylindrical form. The inner diameter of the pipeline unit 91 and the inner diameter of the mesh unit 93 are the same, or have sizes so that the defibration object that is being transferred does not become entangled by providing a step due to the difference between the respective inner diameters.

The enclosure unit 92 encloses the pipeline unit 91 so that the mesh unit 93 (plurality of openings 94) is positioned in the interior (so that the mesh unit 93 is not exposed). The enclosure unit 92 has a cylindrical surface and a cylindrical shape that has an upper surface and a lower surface that are in contact with the cylindrical surface. The upper surface and the lower surface of the enclosure unit 92 are in contact with a part that is not the mesh unit 93 in the pipeline unit 91. The enclosure unit 92 in the transfer direction of the defibration object has a larger size of the enclosure unit 92 (distance between the upper surface and the lower surface) than the size of the mesh unit 93. In addition, the spatial cross-sectional area of the enclosure unit 92 in the direction perpendicular to the transfer direction of the defibration object is larger than the pipeline unit 91. That is, the inner diameter of the enclosure unit 92 is larger than the outer diameter of the pipeline unit 91. Sound muffling material may be provided on the inner side of the enclosure unit 92 to improve the sound absorption performance.

The plurality of openings 94 is the openings (holes in the mesh unit 93) formed in the mesh unit 93. In the example shown in FIG. 2B, the shape of the openings 94 is square, but may be polygonal, circular, or elliptical. The shapes and sizes of the plurality of openings 94 are preferably the same. The plurality of the openings 94 is preferably arranged at equal intervals.

The size of the openings 94 (holes in the mesh unit 93) becomes a size that does not pass the defibration object that passes through the pipeline unit 91. To pass the pieces that were crushed in the crushing unit 10 and the residue that did not pass through the openings of the screening unit 40 in the first transfer unit 81, the size of the openings 94 of the first sound muffling unit 90*a* provided in the first transfer unit 81 is smaller than the sizes of the pieces crushed by the crushing unit 10 and the openings of the screening unit 40. In addition, to pass the pieces cut by the second cutting unit 78*b* in the seventh transfer unit 87, the size of the openings 94 of the second sound muffling unit 90*b* provided in the seventh transfer unit 87 is smaller than the pieces cut by the second cutting unit 78*b*. For example, when the short side of the pieces cut up in the crushing unit 10 is 3 mm, the size of the openings of the screening unit 40 is 1.2 mm; and when the short side of the pieces (cut end material) cut up by the second cutting unit 78*b* is 5 mm, the size (opening) of the openings 94 of the first sound muffling unit 90*a* is set to no more than 1.2 mm (e.g., 1 mm), and the size of the openings 94 of the second sound muffling unit 90*b* is set to no more than 5 mm (e.g., 3 mm).

Because the cross-sectional area of the flow path rapidly expands and contracts due to the enclosure unit 92 enclosing the pipeline unit 91 in the sound muffling unit 90 shown in FIG. 2, the noise of the defibrating unit 20 can be reduced by the sound muffling effect caused by expansion of the cross-sectional area of the flow path. In addition, the defibration object (pieces) can be prevented from accumulating in the enclosure unit 92 (expanded part of the flow path) by providing the mesh unit 93 as a part of the pipeline unit 91 inside of the enclosure unit 92 and setting the size of the openings 94 of the mesh unit 93 to a size that does not pass the defibration object.

Figure 3:
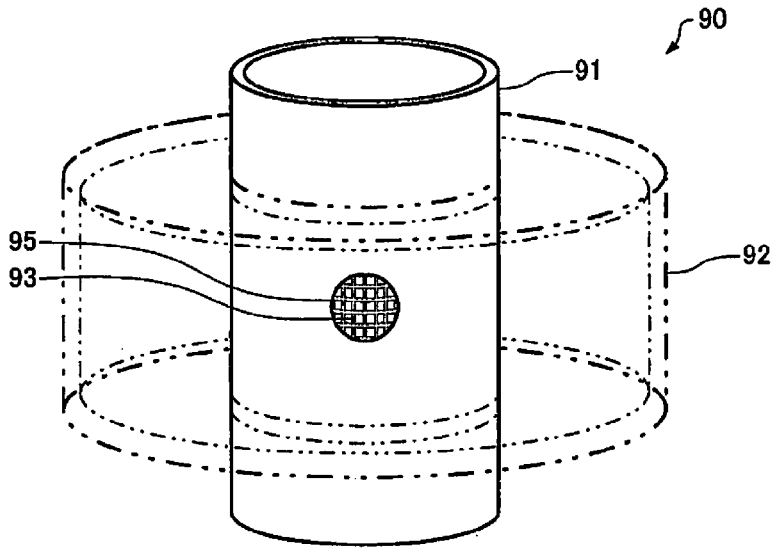
FIG. 3 is a perspective diagram that schematically shows the interior of the sound muffling unit.

Instead of providing the mesh unit 93 formed over the entire circumference in the circumferential direction of the pipeline unit 91, as shown in FIG. 3, a hole unit 95 may be provided in a part in the circumferential direction of the pipeline unit 91 inside of the enclosure unit 92, and the mesh unit 93 may be provided in the hole unit 95. Due to the sound muffling unit 90 shown in FIG. 3, the noise of the defibrating unit 20 can be reduced because the sound resonates in the space inside of the enclosure unit 92 due to the hole unit 95; and by providing a mesh unit 93 in the hole unit 95, the accumulation of defibration object in the enclosure unit 92 can be prevented. A plurality of holes 95 may be provided in the pipeline unit 91.

In the sound muffling unit 90 shown in FIG. 2, the sounds in the wide frequency band from approximately 100 Hz to 2 kHz can be attenuated. In addition, the sounds in a particular frequency band can be attenuated in the sound muffling unit 90 shown in FIG. 3. Thus, the sound muffling unit 90 shown in FIG. 2 may be used when the sounds in a wide frequency band will be attenuated in response to the frequency characteristics of the noise of the defibrating unit 20. The sound muffling unit 90 shown in FIG. 3 may be used to attenuate the sounds in a particular frequency band. The frequency band that can attenuate sound in the sound muffling unit 90 shown in FIG. 3 is specified by the diameter (area) of the hole unit 95 and the volume of the enclosure unit 92.

Figure 4:
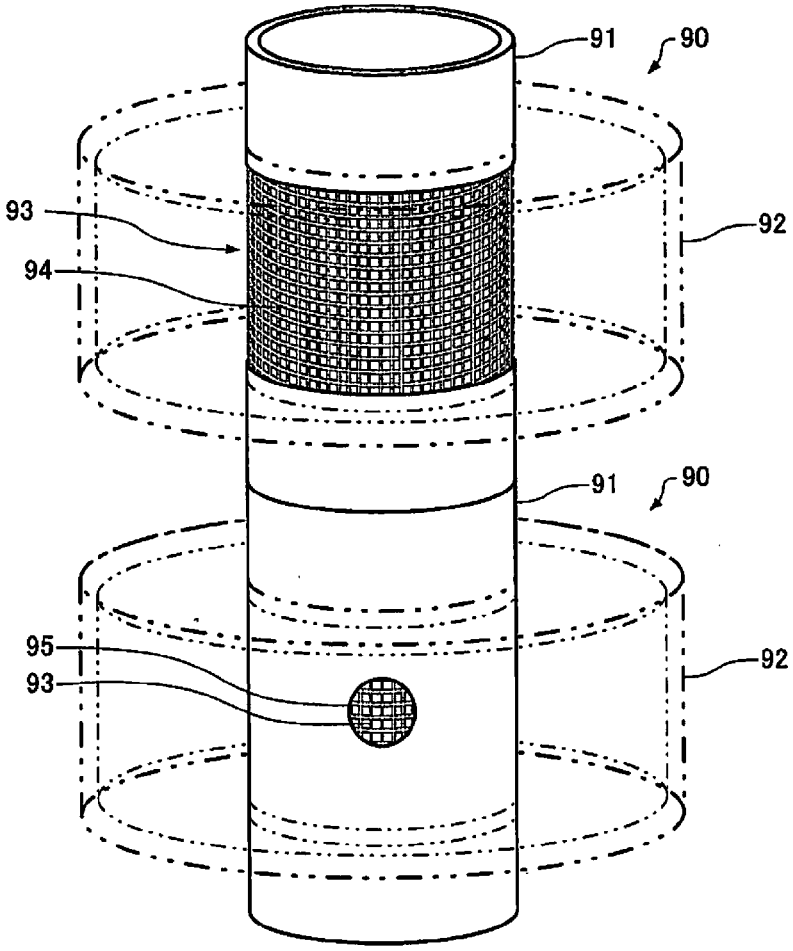
FIG. 4 is a perspective diagram that schematically shows two connected sound muffling units.

As shown in FIG. 4, the sound muffling unit 90 shown in FIG. 2 and the sound muffling unit 90 shown in FIG. 3 may be connected and used as one sound muffling unit. By doing this, sound in a particular frequency band having a large peak can be reduced while reducing the sound in a wide frequency band. When the noise generated by the defibrating unit 20 undergoes frequency analysis, the frequency components of the noise pass through a wide frequency band. Of these, the frequency band having the largest contribution to the noise is the frequency band of the sounds generated when the defibration object collides with the impeller blades of the defibrating unit 20. Thus, the sound muffling unit 90 shown in FIG. 2 and the sound muffling unit 90 shown in FIG. 3 are combined, and if the diameter of the hole unit 95 of the sound muffling unit 90 shown in FIG. 3 and the size of the enclosure unit 92 are adjusted to match the frequency band of the collision sounds of the defibration object, then noise of the defibrating unit 20 can be effectively reduced.

Figure 5A:
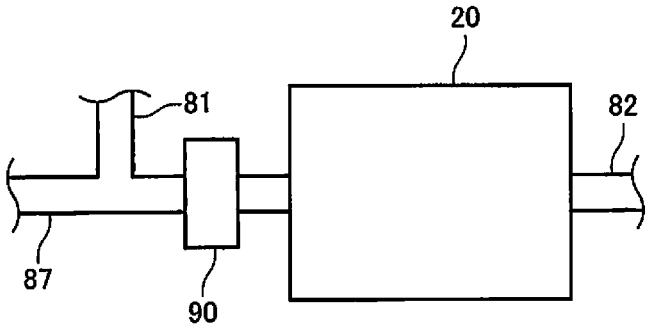
FIG. 5A and FIG. 5B are diagrams for explaining the configuration of the sound muffling unit.

In the example shown in FIG. 1, the case when a sound muffling unit 90 is provided in each of the first transfer unit 81 and the seventh transfer unit 87 was explained. As shown in FIG. 5A, the sound muffling unit 90 may be provided between the junction point of the first transfer unit 81 and the seventh transfer unit 87, and the defibrating unit 20. In this case, the size of the openings 94 is determined so that the smallest defibration object is not passed from among the defibration object passed by the first transfer unit 81 and the defibration object passed by the seventh transfer unit 87. For example, when the short side of pieces cut by the crushing unit 10 is 3 mm, the size of the openings of the screening unit 40 is 1.2 mm; and when the short side of pieces cut by the cutting unit 78 is 5 mm, the size of the openings 94 is no more than 1.2 mm (e.g., 1 mm).

Figure 5B:
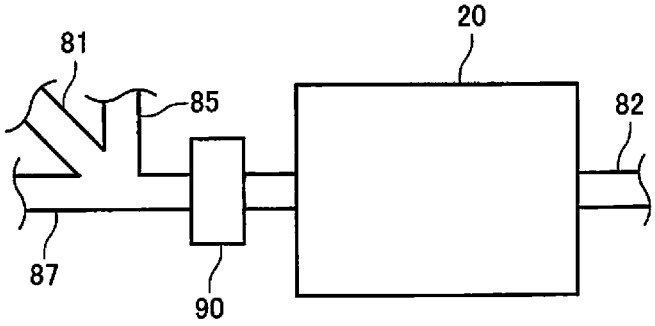

In addition, the example shown in FIG. 1 explained the transfer of the residue from the screening unit 40 through the fifth transfer unit 85, the hopper 15, and the first transfer unit 81 to the defibrating unit 20. The configuration may transfer residue from the screening unit 40 to the defibrating unit 20 by directly joining the fifth transfer unit 85 to the first transfer unit 81 and the seventh transfer unit 87. In this case, in addition to the first transfer unit 81 and the seventh transfer unit 87, the sound muffling unit 90 may be provided in the fifth transfer unit 85. As shown in FIG. 5B, the sound muffling unit 90 may be provided between the junction point of the first transfer unit 81, the fifth transfer unit 85, and the seventh transfer unit 87, and the defibrating unit 20.

3. Test Example

Figure 6:
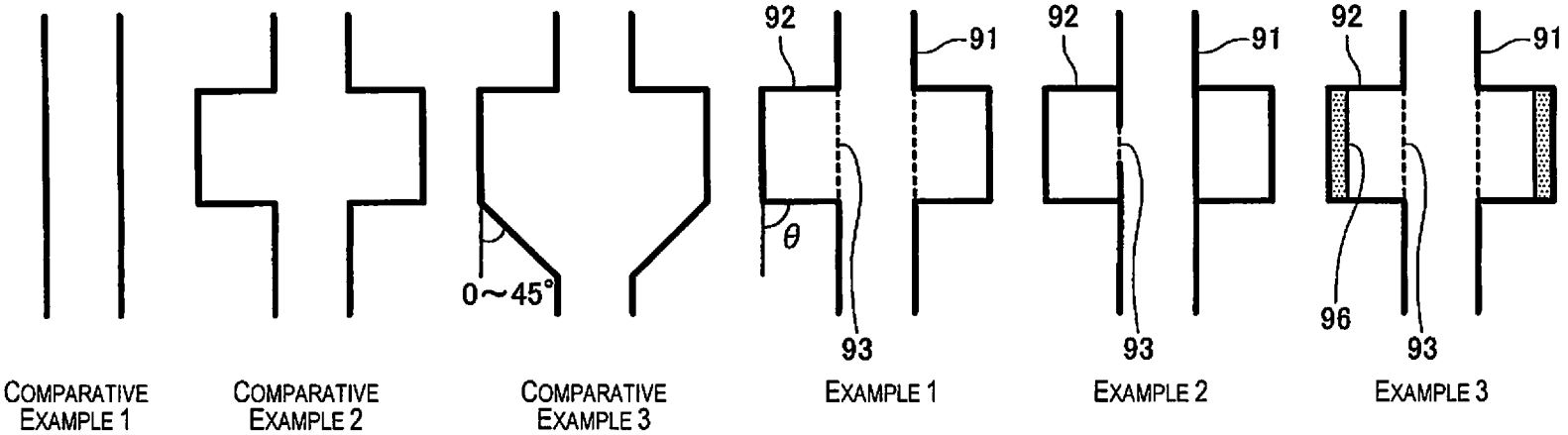
FIG. 6 is a cross-sectional diagram that schematically shows each structure used in the test.

The sound muffling unit 90 of this embodiment was used in a test that measured noise during defibration by the defibrating unit 20 near the material feed port (hopper 15). FIG. 6 is a cross-sectional diagram that schematically shows each structure used in the tests. In the test, the structures of Comparative Examples 1 to 3 and Examples 1 to 3 shown in FIG. 6 measured the noise levels at the position separated by 1 m from the hopper 15 by using a sound level meter. And the accumulation or no accumulation of material (defibration object) in the sound muffling unit 90 was evaluated when the pipe was in the vertical direction and when the pipe was in the horizontal direction. Here, Example 1 is the sound muffling unit 90 shown in FIG. 2 (configuration provided with the mesh unit 93 over the entire circumference in the circumferential direction of the pipeline unit 91). Example 2 is the sound muffling unit 90 shown in FIG. 3 (configuration provided with the mesh unit 93 in the hole unit 95 formed in a part of the circumferential direction of the pipeline unit 91). Example 3 is the configuration provided with the sound absorbing material 96 on the inside of the enclosure unit 92 of the sound muffling unit 90 shown in FIG. 2. In FIG. 6, the material is transferred toward the downstream side in the drawing, and the defibrating unit 20 is connected at the lower side in the drawing.

Table 1 shows the test results. In Table 1, "O" indicates no accumulation of materials, and "X" indicates the accumulation of materials.

TABLE 1

| | Noise [dB] | Accumulation of materials (vertical pipe) | Accumulation of materials (horizontal pipe) |
|---|---|---|---|
| Comparative Example 1 | 98 | O | O |
| Comparative Example 2 | 76 | X | X |
| Comparative Example 3 | 84 | O | X |
| Example 1 | 77 | O | O |
| Example 2 | 80 | O | O |
| Example 3 | 70 | O | O |

In Comparative Example 1, there were no sound muffling effects because of the absence of an expanded part in the flow path, and the noise increased to 98 dB. In addition, in Comparative Example 2, although the sound muffling performance was high because the expanded part was provided in the flow path, material accumulated in the expanded part. In Comparative Example 3, although the accumulation of material was not seen when the pipe was arranged vertically because a taper was provided on the downstream side of the expanded part, the sound muffling performance was lower compared to Comparative Example 2 by providing the taper, and the accumulation of material was seen when the pipe was arranged horizontally.

Example 1 and Example 2 maintained sound muffling performance equal to that of Comparative Example 2, did not accumulate material through the provision of the mesh unit 93, and could establish both the sound muffling performance and the material transfer characteristic. Through the provision of the sound absorbing material 96 inside the expanded part (enclosure unit 92), Example 3 markedly attenuated sounds in the high-frequency band above 1 kHz, and reduced noise by 7 dB than in Example 1. In addition, when sound absorbing material was provided in a conventional sound muffling device, the problem was that material adhered to the sound absorbing material, but in the sound muffling unit 90 of this embodiment, this type of problem did not develop because the material and the sounds are separated by the mesh unit 93.

In the sound muffling unit 90 of this embodiment, preferably, the angle θ formed by the extension of the side surface and the bottom surface (or top surface) of the enclosure unit 92 is 90° (no taper in the enclosure unit 92), but 8 may be 45° to 60° larger.

4. Configuration of Defibrating Unit

Figure 7A:
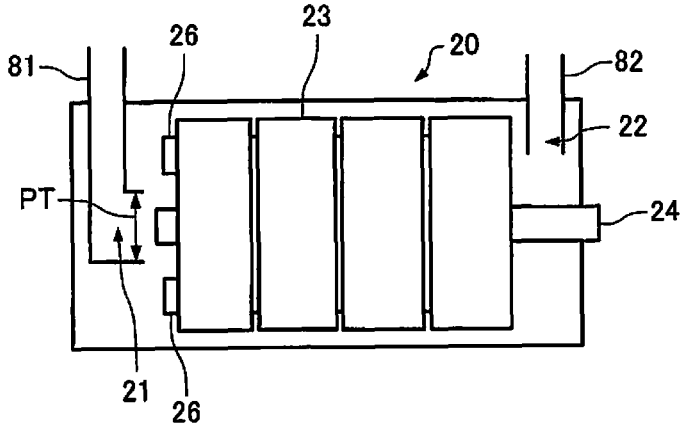
FIG. 7A is a side view diagram that schematically shows the interior of the defibrating unit.
Figure 7B:
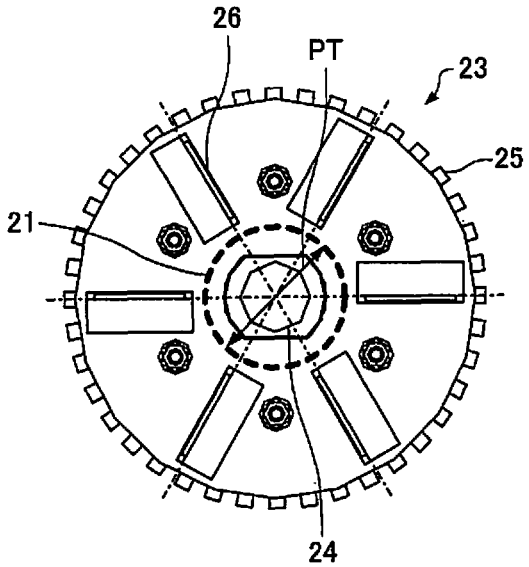
FIG. 7B and FIG. 7C are front views of the rotor seen from the introduction port side.

FIG. 7A is a side view diagram that schematically shows the interior of the defibrating unit 20. The defibrating unit 20 has a rotor 23. The rotor 23 rotates about a rotation shaft 24. FIG. 7B is a front view of the rotor 23 when viewed from the introduction port 21 side. A plurality of projections 25 for defibration is provided on the outer surface of the rotor 23. In addition, a plurality of impeller blades 26 is provided on the side opposite the introduction port 21 of the rotor 23. When rotor 23 rotates about the rotation shaft 24, airflow is generated by the impeller blades 26. The defibration object (pieces) is suctioned from the introduction port 21 by the airflow, defibration of the suctioned defibration object is performed, and the suctioned defibration object is transferred to the discharge port 22.

As described above, the frequency band that contributes the most to the noise of the defibrating unit 20 is the frequency band of sounds generated when the defibration object collides with the impeller blades 26 of the defibrating unit 20. Therefore, in the defibrating unit 20 in this embodiment, as shown in FIG. 7A and FIG. 7B, when viewed from the introduction port 21 side, the introduction port 21 is positioned so that the impeller blades 26 do not overlap the introduction port 21 (inner diameter PT of the introduction port 21). By doing this, the noise generated when the defibration object collides with the impeller blades 26 can be prevented from entering directly into the introduction port 21 (that is, first transfer unit 81 and seventh transfer unit 87); and the noise of the defibrating unit 20 emerging from the hopper 15 and the hopper 17 can be reduced.

Figure 7C:
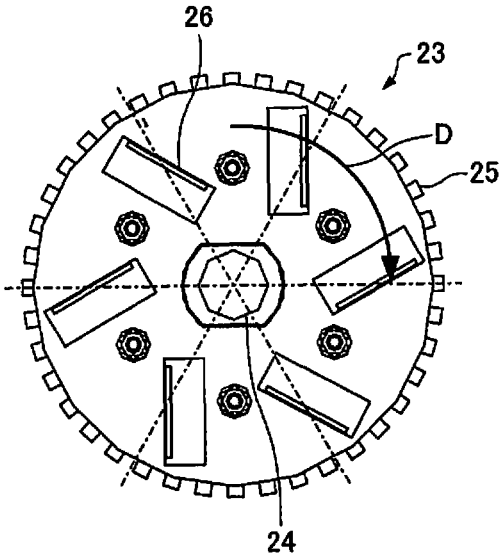

In the example shown in FIG. 7B, the impeller blades 26 are arranged along lines extending radially from the center of the rotation shaft 24. However, as shown in FIG. 7C, the impeller blades 26 may be arranged so that the flat surfaces of the impeller blades 26 are inclined with respect to the lines extending radially from the center of the rotation shaft 24, and the impeller blades 26 may tilt backward with respect to the direction of rotation (direction indicated by D in the drawing) of the rotor 23. When the impeller blades 26 are positioned to tilt backwards with respect to the direction of rotation, collision sounds can be reduced because the angle becomes large when the defibration object collides with the impeller blades 26, and the noise of the defibrating unit 20 can be reduced. In addition, by tilting the impeller blades 26 backwards with respect to the direction of rotation, the transfer capacity of the defibration object can be improved because the defibration object easily avoids the outer peripheral side of the rotor 23.

5. Modified Example

The present invention includes configurations that are essentially identical to the configurations described in the embodiment (configurations having the same functions, methods, and results; or configurations having the same objectives and effects). In addition, the present invention includes configurations in which parts that are not essential in the configurations explained in the examples are replaced. And the present invention includes configurations that carry out the actions and effects identical to those in the configurations explained in the examples, or configurations that are able to achieve the same objectives. In addition, the present invention includes configurations in which known technologies were added to the configurations described in the examples.

In FIGS. 2 to 4, the cross-sectional plane of the enclosure unit 92 was circular, but is not limited to that. The cross-sectional plane may be elliptical or polygonal if the exterior of the pipeline unit 91 is enclosed. There is almost no difference in the noise in Examples 1 to 3 due to the shape of the cross-sectional plane, if the area of the cross section is the same.

A sheet manufactured by the sheet manufacturing apparatus 100 primarily indicates a sheet-like object. However, the shape is not limited to a sheet, a board form or a web form is possible. The sheet in this Specification is divided into paper and nonwoven cloth. Paper includes pulp or used paper as the raw materials formed into thin sheets, and includes recording paper, wallpaper, wrapping paper, colored paper, drawing paper, and Kent paper that have the objective of writing or printing. Nonwoven cloth is thicker and has less strength than paper, and includes ordinary nonwoven cloth, fiberboard, tissue paper, paper towels, cleaning cloths, filters, liquid absorbing materials, sound absorbing materials, cushioning materials, and mats. The raw materials may be plant fibers such as cellulose, and the like; synthetic fibers such as polyethylene terephthalate (PET), polyester, and the like; and animal fibers such as wool, silk, and the like.

In addition, a water moisture sprayer may be provided to spray and add water moisture to the deposited material that was deposited in the deposition unit 72. By doing this, the strength of the hydrogen bonds can be increased when forming the sheet P. The spraying to add water moisture is conducted on the deposited material before passing through the heater roller 76. The water moisture sprayed by the water moisture spraying device may have the additives of starch or polyvinyl alcohol (PVA). By doing this, the strength of the sheet P can be further improved.

The sheet manufacturing apparatus 100 may not have the crushing unit 10. For example, the crushing unit 10 is not needed if the raw materials are materials crushed by a conventional shredder.

There may not be the fifth transfer unit 85 as the return flow path. The residue may be collected and discarded without returning to the defibrating unit 20. In addition, if the defibrating unit 20 has the efficiency to not output residue, the fifth transfer unit 85 becomes unnecessary.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus, comprising:

a defibrating unit configured to defibrate a defibration object in the air;

a sheet forming unit configured to form a sheet by using at least a part of defibrated material that has been defibrated by the defibrating unit; and a flow path configured to transfer the defibration object to the defibrating unit, the flow path having a pipeline unit through which the defibration object passes, an opening having a size through which the defibration object does not pass on a surface of the pipeline unit, and an enclosure unit enclosing the pipeline unit such that the opening is positioned inside.

2. The sheet manufacturing apparatus according to claim 1, wherein the opening is an opening formed in a mesh unit having a net-like form.

3. The sheet manufacturing apparatus according to claim 2, wherein the mesh unit is arranged in an entire circumference in a circumferential direction of the pipeline unit.

4. The sheet manufacturing apparatus according to claim 2, wherein the mesh unit is arranged in a part in a circumferential direction of the pipeline unit.

5. The sheet manufacturing apparatus according to claim 1, further comprising a crushing unit configured to crush material including fibers, wherein the defibrating unit is configured to defibrate a crushed piece, which has been crushed as the defibration object by the crushing unit, in the air, and the flow path is provided between the crushing unit and the defibrating unit.

* * * * *